US008863671B2

(12) United States Patent
Shaw

(10) Patent No.: US 8,863,671 B2
(45) Date of Patent: Oct. 21, 2014

(54) SECONDARY CONTAINMENT PALLET HAVING FLEXIBLE WALLS

(71) Applicant: Mark D. Shaw, Ponte Vedra Beach, FL (US)

(72) Inventor: Mark D. Shaw, Ponte Vedra Beach, FL (US)

( * ) Notice: Subject to any disclaimer, the term of this patent is extended or adjusted under 35 U.S.C. 154(b) by 0 days.

(21) Appl. No.: 13/740,543

(22) Filed: Jan. 14, 2013

(65) Prior Publication Data

US 2014/0196633 A1 Jul. 17, 2014

(51) Int. Cl.
*A47B 85/00* (2006.01)
*B65D 19/40* (2006.01)
*B65D 19/00* (2006.01)

(52) U.S. Cl.
CPC ..... *B65D 19/40* (2013.01); *B65D 19/0002* (2013.01)
USPC ..... 108/25; 108/56.3

(58) Field of Classification Search
USPC ..... 108/25, 51.11, 51.3, 55.1, 56.1, 56.3, 108/57.13, 24; 206/386
See application file for complete search history.

(56) References Cited

U.S. PATENT DOCUMENTS 3,858,526 A * 1/1975 Lombard et al. ..... 206/386
3,999,653 A * 12/1976 Haigh et al. ..... 206/584
4,022,321 A * 5/1977 Barnett ..... 206/386
4,930,632 A * 6/1990 Eckert et al. ..... 206/386
5,036,976 A * 8/1991 Sechler et al. ..... 206/386
5,092,251 A * 3/1992 Hamaker et al. ..... 108/57.13
5,249,699 A * 10/1993 Williams ..... 220/571
5,307,931 A * 5/1994 Gillispie et al. ..... 206/386
5,359,955 A * 11/1994 Grebenyuk ..... 108/57.13
5,392,911 A * 2/1995 Gillispie et al. ..... 206/386
5,562,047 A * 10/1996 Forney et al. ..... 108/57.13
5,615,608 A * 4/1997 Shaw et al. ..... 108/55.3
5,791,501 A * 8/1998 Baldwin, Jr. ..... 211/183
6,382,108 B1 * 5/2002 Stanek et al. ..... 108/55.1
6,745,704 B2 * 6/2004 Carter et al. ..... 108/55.1
6,895,871 B1 * 5/2005 Smith et al. ..... 108/115
7,811,522 B2 * 10/2010 Mathus et al. ..... 422/400
8,424,682 B2 * 4/2013 Cassina ..... 206/386
2002/0008517 A1 * 1/2002 Derby et al. ..... 324/318
2005/0145521 A1 * 7/2005 Perkins ..... 206/386
2012/0261303 A1 * 10/2012 Schutz ..... 206/599

* cited by examiner

*Primary Examiner* — Daniel Rohrhoff
(74) *Attorney, Agent, or Firm* — Thomas C. Saitta

(57) ABSTRACT

A secondary or spill containment pallet that is the combination of a base or reservoir member composed of a flexible, non-self-sustaining material, one or more horizontally disposed apertured deck members, and an internal load-bearing support structure capable of supporting the deck member and liquid containers disposed on the deck members. The support structure maintains the deck members a suitable distance above the bottom of the base member such that a large internal volume is created, whereby liquid leaking or spilling from the containers will be received and retained within the base member, the walls of which are suspended from or attached to the deck members.

17 Claims, 3 Drawing Sheets

SECONDARY CONTAINMENT PALLET HAVING FLEXIBLE WALLS

BACKGROUND OF THE INVENTION

The invention relates generally to the field of pallets structured to support one or more large liquid containers, such as 55 gallon drums or the like, and more particularly relates to such pallets that provide a reservoir or sump having an internal volume greater than the capacity of the liquid containers supported thereon such that any spillage or leakage from the liquid containers is retained within the pallet and does not pass into the environment.

Pallets that are designed, sized and structured to retain liquid spills or leaks from liquid retaining containers supported by the pallets are known, such devices often being referred to as a secondary or spill containment device. In a typical spill or secondary containment pallet, a rigid-walled base member designed to receive and retain liquids supports a horizontally disposed deck, grating or apertured sheet member, with the liquid containment members being positioned on the deck member. The dimensions of the base for particular applications are chosen such that its internal volume is sufficient to receive and retain all the liquid retained within the liquid containers should all the liquid leak from the containers.

While these rigid-walled pallets have proven to be suitable for secondary spill containment, the relatively large size and rigid structure of the base member results in problems in both storage and transport. It is an object of this invention to address this problem by providing a spill containment pallet comprising a liquid-retaining base member with flexible walls and bottom, one or more deck members, and an internal load-bearing support structure positioned within the base member to support the deck member a sufficient distance above the bottom to define an internal area with large volume, the walls of the deck member being suspended from the deck member. All of the elements comprise an assembly that can be easily dismantled such that the pallet can be stored and transported in a folded or compact configuration.

SUMMARY OF THE INVENTION

The invention, as illustrated in the various non-limiting embodiments described and shown herein, is a spill or secondary containment pallet designed, structured and adapted to support one or more large volume liquid containers, such as for example 55 gallon drums, the pallet being capable of receiving and retaining a large volume of liquid, and in particular capable of receiving and retaining all the liquid contained by the liquid containers supported thereon in the event of a spillage or leakage. The pallet is an assembly comprising the combination of a liquid-retaining base or reservoir member, an internal load-bearing support structure and one or more horizontally disposed deck members. The base member comprises a bottom and wall members, the base member being composed of a flexible material such that it may be folded, rolled, collapsed or otherwise disposed into a compact configuration. The internal support structure comprises a plurality of load-bearing members positioned within the base member which support the deck members, the internal support structure and deck members being capable of supporting the weight of the liquid containers such that a large volume internal area is defined within the base member. The walls of the base member are not self-supporting when retaining liquid and are suspended from the deck members. In this manner, the pallet assembly may be dismantled by releasing the base member walls from the deck member and then removing the deck members and internal support structure from the base member, such that the pallet may be compactly stored and transported.

In one embodiment, the invention is a secondary containment pallet assembly comprising in combination at least one deck member, an internal load-bearing support structure supporting said at least one deck member in a horizontal position, and a collapsible liquid retaining base member, said internal load-bearing support structure being positioned within said collapsible liquid retaining base member; wherein said at least one deck member, said internal load-bearing structure and said collapsible liquid retaining base member are separable from each for disassembly and reassembly; wherein said liquid retaining base member comprises a bottom and wall members defining an internal volume, said wall members being non-self-sustaining under liquid load absent connection to said at least one deck member, said internal support structure and said at least one deck member being positioned within said base member; and wherein said wall members are releasably connected to said deck member.

DETAILED DESCRIPTION OF THE INVENTION

Figure 1:
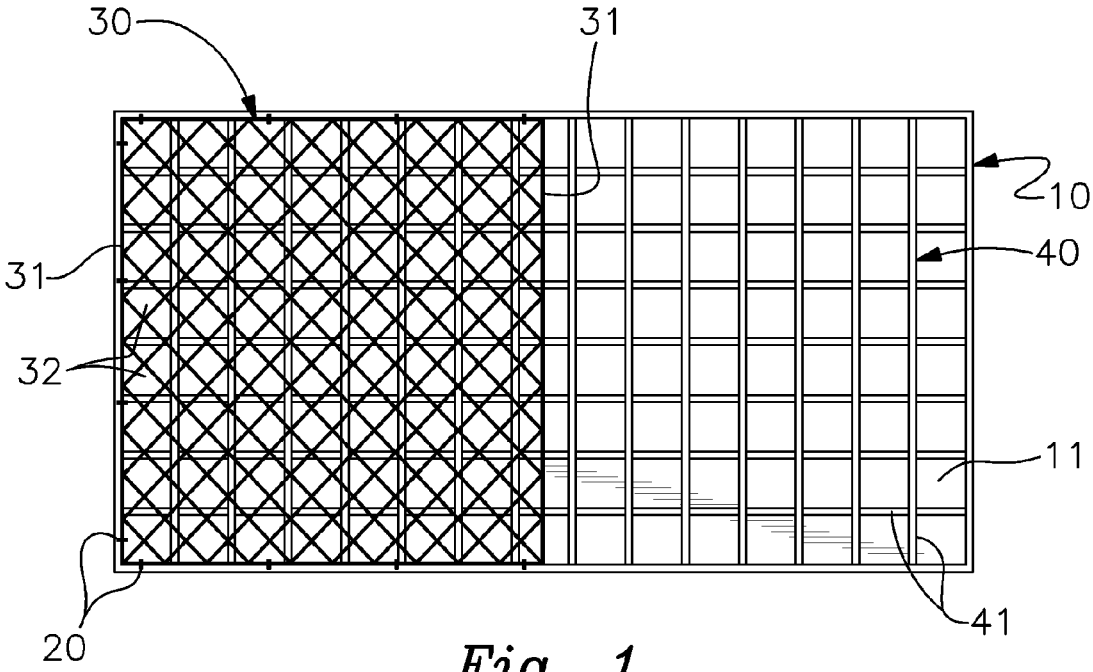
FIG. 1 is atop view of an embodiment of the invention, one of the deck members being removed to expose the internal support structure.

With reference to the drawings, the invention is shown in general to be a secondary or spill containment pallet comprising the combination of a base or reservoir member 10 composed of a flexible, non-self-supporting material when under liquid load, one or more horizontally disposed apertured deck members 30, and an internal load-bearing support structure 40 capable of supporting the deck member 30 and liquid containers disposed on the deck members 30. The support structure 40 maintains the deck members 30 a suitable distance above the bottom 11 of the base member 10 such that a large internal volume 16 is created, whereby liquid leaking or spilling from the containers will be received and retained within the base member 10. Thus for example, for a pallet designed to support two 55 gallon drums, the internal volume 16 will be greater than 110 gallons.

Figure 2:
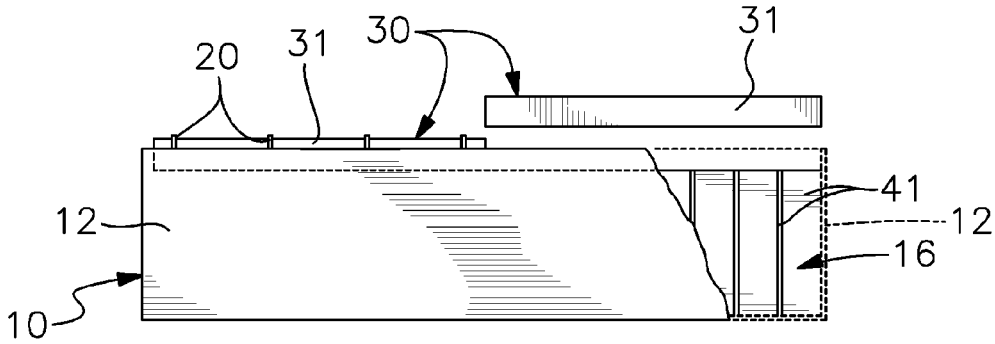
FIG. 2 is a side view of the embodiment of FIG. 1, with one of the deck members shown in expanded view and with part of the base member removed to expose the internal support structure.

As shown in FIGS. 1 and 2, the pallet will typically possess a rectangular configuration, although other shapes are possible. The base or reservoir member 10 comprises a bottom 11 and side wall members 12, formed from a liquid impermeable, flexible sheet material characterized by its ability to be easily folded, rolled or otherwise manipulated because the material is non-self-sustaining when disposed vertically. The material of composition is preferably resistant to degradation from various hazardous or chemical liquids. The wall members 12 in particular lack the structural rigidity to be self-sustaining when under liquid load, i.e., when a large volume of liquid is present in the base member 10. With this construction, when not in use the base member 10 may be folded, rolled or otherwise collapsed into a low volume configuration for storage or transport.

Figure 9:
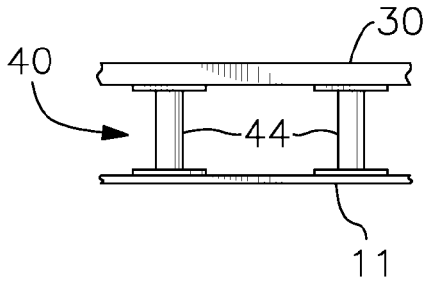
FIG. 9 shows an alternative embodiment for the internal support structure, the internal support structure comprising support column members.
Figure 4:
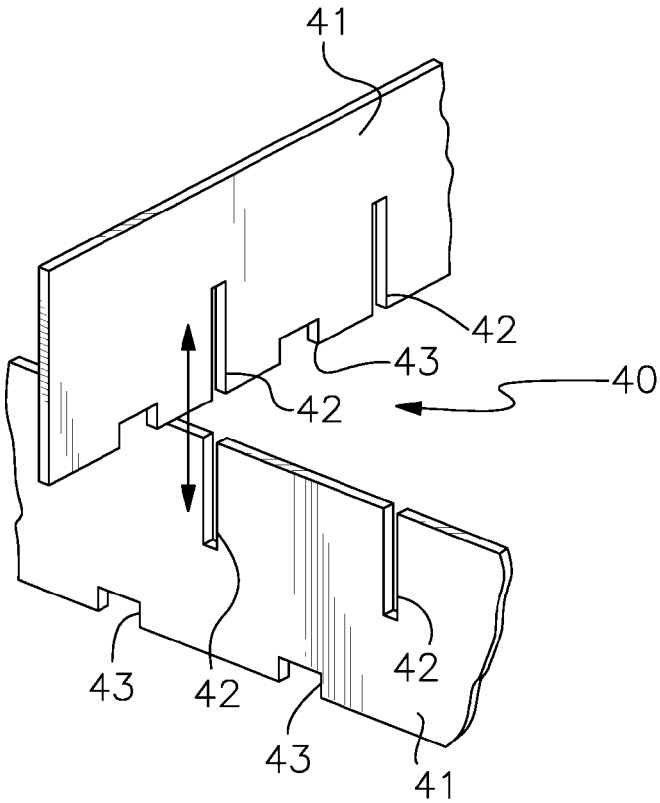
FIG. 4 is a partial perspective of an embodiment for the internal support structure, the internal support structure comprising plural intersecting wall members.

Positioned within the internal volume 16 of the base member 10 is the internal, load-bearing support structure 40, which is designed, structured and adapted to support the one or more deck members 30 in a horizontal orientation a suitable distance above the bottom 11 of the base member 10. The internal support structure 40 is sufficiently strong to support the deck members 30 and loaded liquid containers, and the total volume occupied by the support structure 40 should not excessively reduce the total internal volume of the base member 10. Internal support structure 40 may comprise an assembly of components, as shown in FIGS. 1, 2 and 4, or may comprise a plurality of individual support members, as shown in FIG. 9. In the first embodiment, the support structure 40 is shown as comprising rigid, intersecting, support wall members 41, the support wall members 41 being provided with mating notches 42 that allow the support wall members 41 to be assembled into a grid or lattice pattern. The support wall members 41 are preferably provided with flow openings 43 such that liquid may rapidly spread throughout the base member 10. In the second embodiment shown, the support structure 40 comprises a plurality of column members 44 that are positioned within the base member 10. Embodiments for the internal support structure 40 differing from the embodiments shown and described may also be utilized. Preferably the deck members 30, internal support structures 40 and base member 10 are separable from each other for disassembly and reassembly.

The one or more deck members 30 comprise decks, gratings, sheet members, mesh members or the like that are sufficiently rigid to support loaded liquid containers, and which are provided with apertures 32 to allow passage of leaking or spilled liquid into the base member 10. The deck members 30 are most preferably separable from the support structure 40 for storage and transport, but may be formed as a unitary member. The deck members 30 comprise a perimeter wall 31 of sufficient rigidity to support the wall members 12 of the base member 10 in suspended manner.

Figure 3:
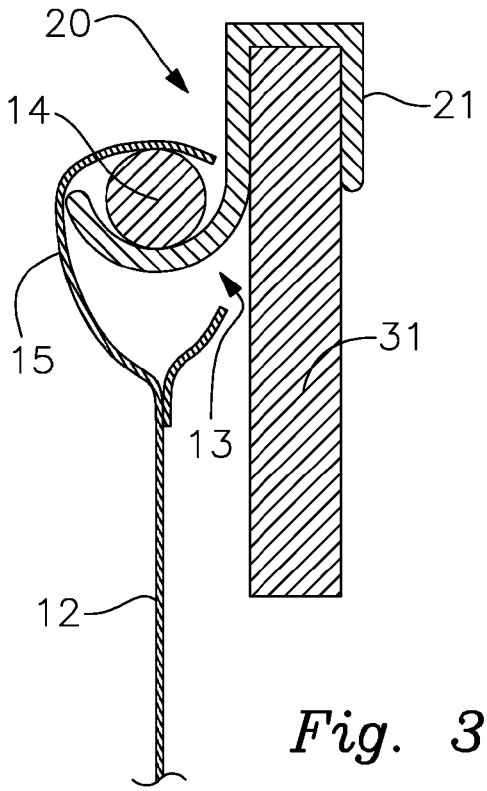
FIG. 3 is a cross-sectional view of an embodiment showing the deck member wall suspended from the deck member.

Because the material of composition of the base member 10 is flexible, the wall members 12 are non-self-sustaining under liquid load, i.e., the weight of the liquid would result in collapse of the wall members 12 unless the wall members 12 are connected to another structure. To assemble and utilize the spill containment pallet, the wall members 12 are releasably connected, suspended from or attached to the deck members 30 by suspension members or assemblies 20. In a preferred embodiment shown in FIGS. 1 through 3, the suspension assemblies 20 comprise horizontally disposed rod members 14 retained within edge sleeves 15 formed in the upper edges of the wall members 12. The edge sleeves 15 are provided with openings 13 each adapted to receive a hook member 21. With this structure, the lower end of the hook member 21 extends through the opening 13 and supports the rod member 14, and the upper end of the hook member 21 is positioned over the perimeter wall 31 of the deck member 30. The hook members 21 are suitably spaced along the perimeter walls 31 to provide sufficient support to the suspended wall members 12, with the rod members 14 adding horizontal structural integrity. For base members 10 of greater dimensions, multiple rod members 14 may be utilized within a single edge sleeve 15 such that the base member 10 may be collapsed or folded into a relatively small configuration without requiring removal of long rod members 14.

Figure 5:
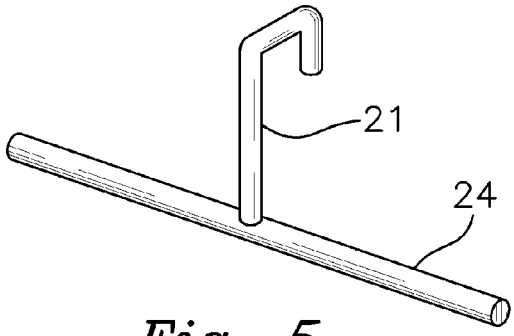
FIG. 5 shows an alternative embodiment for the suspension assembly, the suspension assembly comprising a hook member.
Figure 6:
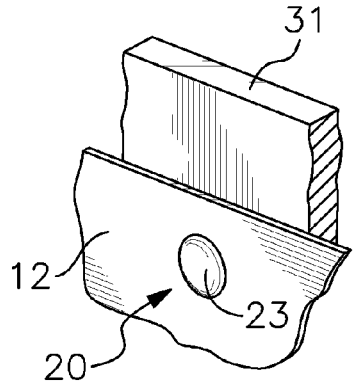
FIG. 6 shows an alternative embodiment for the suspension assembly, the suspension assembly comprising a snap member.
Figure 7:
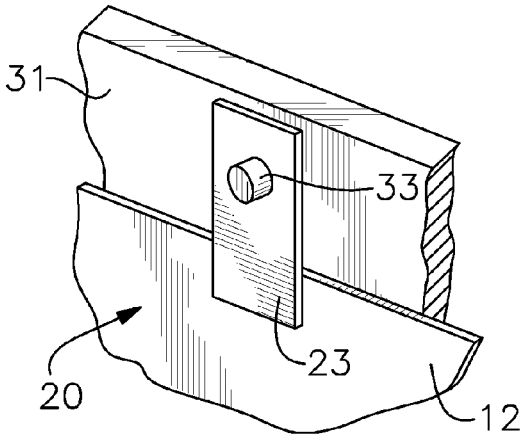
FIG. 7 shows an alternative embodiment for the suspension assembly, the suspension assembly comprising an apertured strap member retained on a peg member.
Figure 8:
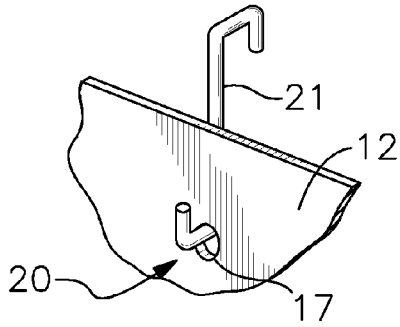
FIG. 8 shows an alternative embodiment for the suspension assembly, the suspension assembly comprising a hook member inserted through a slot in the base wall member.

Alternative embodiments are envisioned without horizontal rod members 14, such that the wall members 12 are connected directly to the deck members 30. For example, as shown in FIG. 8, apertures or slots 17 may be disposed in the wall members 12 with the lower portion of the hook member 21 extending through the slot 17. Other embodiments for the suspension assembly 20, such as hooks, clips, loops, straps, hook-and-loop fasteners, elastic cords, snaps or the like, may be utilized. As illustrated in FIG. 5, the hook member 21 here comprises a horizontally extending rod member 24 that is inserted into the edge sleeve 15 of the wall member 12. In FIG. 6, the suspension assembly 20 here comprises a snap member 23 that joins the wall member 12 to the perimeter wall 31 of the deck member 30. In FIG. 7, the suspension assembly 20 here comprises an apertured strap member 23 affixed to the wall member 12, the strap member 23 being mounted onto a peg or post member 33 extending from the perimeter wall 31 of the deck member 30. Alternatively, the hook members 21 or similar members may be permanently joined to either the wall members 12 or the deck members 30.

To assemble the spill or secondary containment pallet of the invention, the flexible base or reservoir member 10 is unfolded or unrolled such that the bottom 11 is substantially flat and fully expanded. The internal, load-bearing, support structure 40 is assembled if required and then properly positioned within the base member 10. The deck members 30 are then placed onto the support structure 40 and the wall members 12 of the base member 10 are raised and secured to the deck members 30 using the suspension assemblies 20. In this manner the pallet now defines a large internal volume 16 capable of retaining liquid. Disassembly of the pallet is accomplished by reversing the steps.

It is understood that equivalents and substitutions for certain elements and structures described and illustrated above may be obvious to one of skill in the art, and therefore the true scope and definition of the invention is to be as set forth in the following claims.

I claim:

1. A secondary containment pallet assembly comprising:

at least one deck member positioned on an internal load-bearing support structure;

a liquid retaining base member comprising a bottom and wall members defining an internal volume, said base member composed of a collapsible flexible material such that said wall members are non-self-sustaining under liquid load absent connection to said at least one deck member, said internal support structure and said at least one deck member being positioned within said base member; and suspension assemblies releasably connecting said wall members to said at least one deck member, wherein said suspension assemblies comprise slot members disposed in said wall members and hook members connecting said wall members to said at least one deck member.

2. The assembly of claim 1, wherein said internal load-bearing support structure comprises a plurality of individual members which may be disassembled.

3. The assembly of claim 2, wherein said internal load-bearing support structure comprises intersecting notched wall members.

4. The assembly of claim 1, wherein said internal load-bearing support structure comprises column members.

5. The assembly of claim 1, wherein said suspension assemblies are permanently affixed to either said wall members or said at least one deck member.

6. A secondary containment pallet assembly comprising in combination at least one deck member, an internal load-bearing support structure supporting said at least one deck member in a horizontal position, and a collapsible liquid retaining base member, said internal load-bearing support structure being positioned within said collapsible liquid retaining base member;

wherein said at least one deck member, said internal load-bearing structure and said collapsible liquid retaining base member are separable from each for disassembly and reassembly;

wherein said liquid retaining base member comprises a bottom and wall members defining an internal volume, said wall members being non-self-sustaining under liquid load absent connection to said at least one deck member; and wherein said wall members are releasably connected to said at least one deck member and wherein said internal load-bearing support structures comprise a plurality of separable interconnecting support wall members.

7. The assembly of claim 6, wherein said wall members comprise slot members and said assembly further comprises hook members extending through said slot members and connecting said wall members to said at least one deck member.

8. The assembly of claim 6, wherein said wall members comprise edge sleeves having openings, and wherein said assembly further comprises rod members positioned within said edge sleeves and hook members extending through said openings and connecting said rod members to said at least one deck member.

9. The assembly of claim 6, further comprising suspension assemblies releasably connecting said wall members to said at least one deck member.

10. The assembly of claim 9, wherein said suspension assemblies comprise snap members.

11. The assembly of claim 9, wherein said suspension assemblies comprise the combination of apertured strap members and post members.

12. The assembly of claim 9, wherein said suspension assemblies are permanently affixed to either said wall members or said at least one deck member.

13. A secondary containment pallet assembly comprising:

at least one deck member positioned on an internal load-bearing support structure;

a liquid retaining base member comprising a bottom and wall members defining an internal volume, said base member composed of a collapsible flexible material such that said wall members are non-self-sustaining under liquid load absent connection to said at least one deck member, said internal support structure and said at least one deck member being positioned within said base member; and suspension assemblies releasably connecting said wall members to said at least one deck member;

wherein said wall members each comprise an upper edge and wherein suspension assemblies comprise edge sleeves formed in said upper edges of said wall members, said edge sleeves having openings, one or more horizontal rod members positioned within said edge sleeves, and hook members extending through said openings and connecting said rod members to said at least one deck member.

14. The assembly of claim 13, wherein said internal load-bearing support structure comprises a plurality of individual members which may be disassembled.

15. The assembly of claim 14, wherein said internal load-bearing support structure comprises intersecting notched support wall members.

16. The assembly of claim 13, wherein said internal load-bearing support structure comprises column members.

17. The assembly of claim 13, wherein said suspension assemblies are permanently affixed to either said wall members or said at least one deck member.

* * * * *